US006012873A

United States Patent [19]

Copple et al.

[11] Patent Number: 6,012,873

[45] Date of Patent: Jan. 11, 2000

[54] BUOYANT LEG PLATFORM WITH RETRACTABLE GRAVITY BASE AND METHOD OF ANCHORING AND RELOCATING THE SAME

[76] Inventors: Robert W. Copple, 5 Glen Dr., Mill Valley, Calif. 94941; Cuneyt C. Capanoglu, 1215 Encina Dr., Millbrae, Calif. 94030

[21] Appl. No.: 08/941,681

[22] Filed: Sep. 30, 1997

[51] Int. Cl.[7] ..... E02D 5/54; B63B 35/44

[52] U.S. Cl. ..... 405/224; 405/223.1; 405/208; 405/207; 114/264

[58] Field of Search ..... 405/223.1, 204, 405/208, 224, 200, 207, 205; 114/264, 265

[56] References Cited

U.S. PATENT DOCUMENTS

| | | | |
|---|---|---|---|
| 1,365,197 | 1/1921 | Scott . | |
| 2,351,449 | 6/1944 | Noble . | |
| 2,901,890 | 9/1959 | Hutchison . | |
| 2,908,141 | 10/1959 | Marsh, Jr. | 405/223.1 |
| 2,986,889 | 6/1961 | Ludwig . | |
| 3,031,997 | 5/1962 | Nesbitt . | |
| 3,082,608 | 3/1963 | Daniel | 405/223.1 X |
| 3,086,368 | 4/1963 | Popper | 405/224 |
| 3,154,039 | 10/1964 | Knapp . | |
| 3,246,475 | 4/1966 | Booth et al. | 405/200 |
| 3,395,755 | 8/1968 | Manning . | |
| 3,408,821 | 11/1968 | Redshaw | 405/200 |
| 3,540,396 | 11/1970 | Horton | 405/223.1 X |
| 3,550,385 | 12/1970 | Lowd et al. | 405/205 |
| 3,643,446 | 2/1972 | Mott . | |
| 3,646,598 | 2/1972 | Chelminski . | |
| 3,710,580 | 1/1973 | Mott . | |
| 3,720,066 | 3/1973 | Vilain . | |
| 3,919,957 | 11/1975 | Ray et al. | 405/224 X |

(List continued on next page.)

FOREIGN PATENT DOCUMENTS 1302162 7/1962 France .

2174133 10/1986 United Kingdom .

OTHER PUBLICATIONS

W.J. Graff, excerpts from "*Introduction to Offshore Structures*", Gulf Publishing Company 1981, pp. 26–33, 48–65, 78–87, 200–211, 224–269, 308–311.

"The Newcomer Tackles The Moose", published Aug. 27, 1987 in *ENR*, pp. 22, 23, 25.

"Exploring the Ocean's Frontiers", published Dec. 17, 1990 in *Time Magazine*, pp. 98, 100, B4.

J.E. Halkyard, et al., "The Tension Buoyant Tower: A Design for Deep Water," *Proceedings 1991 Offshore Technology Conference*, May 6–9, 1991, Paper presented at 23rd Annual OTC (6700) in Houston, TX, pp. 41–55.

P. Britton, "Offshore Oil—How Deep Can They Go?" *Popular Science*, Jan. 1992, pp. 80–85, 96.

"Oryx–CNG combine to use Spar for Gulf of Mexico development," *Oil & Gas Journal*, Nov. 21, 1994, pp. 33.

S.R. Perryman, et al., "Tension Buoyant Tower for Small Fields in Deepwaters," *Proceedings 1995 Offshore Technology Conference*, May 1–4, 1995, Paper presented at 27th Annual OTC (7805) in Houston, TX, pp. 13–22.

*Primary Examiner*—David Bagnell
*Assistant Examiner*—Jong-Suk Lee
*Attorney, Agent, or Firm*—Coudert Brothers

[57] ABSTRACT

A deep water platform, suitable for use as a hydrocarbon exploration or production facility in very deep offshore waters, and a method of constructing the same are shown. The platform is positioned on top of a buoyant leg structure. During normal drilling operations the platform is anchored by a gravity base tethered with pre-tensioned cables to the buoyant leg structure. According to the invention, the gravity base is retractable to permit the platform to be moved from site to site within a drilling region. Long distance relocation is also possible by retracting the gravity base, disassembling the platform, transporting the component parts, and reassembling the rig in a new location.

14 Claims, 5 Drawing Sheets

U.S. PATENT DOCUMENTS

| | | | |
|---|---|---|---|
| 3,922,868 | 12/1975 | McDonald et al. . | |
| 3,982,492 | 9/1976 | Steddum | 405/223.1 X |
| 3,983,706 | 10/1976 | Kalinowski | 405/223.1 X |
| 3,986,471 | 10/1976 | Haselton | 405/223.1 X |
| 4,040,264 | 8/1977 | Neilon | 405/224.2 |
| 4,060,995 | 12/1977 | Lacroix et al. . | |
| 4,062,313 | 12/1977 | Stram | 405/223.1 X |
| 4,087,984 | 5/1978 | Olav Mo . | |
| 4,110,628 | 8/1978 | Paull et al. | 405/224 X |
| 4,117,690 | 10/1978 | Besse | 405/227 |
| 4,142,819 | 3/1979 | Challine et al. | 405/196 |
| 4,165,196 | 8/1979 | Serrano | 405/205 |
| 4,169,424 | 10/1979 | Newby et al. | 405/224 |
| 4,185,694 | 1/1980 | Horton | 166/350 |
| 4,266,499 | 5/1981 | Tam | 405/224 X |
| 4,365,912 | 12/1982 | Burns | 405/60 |
| 4,373,835 | 2/1983 | Haney | 405/195 |
| 4,468,157 | 8/1984 | Horton | 405/224 |
| 4,470,723 | 9/1984 | Michel et al. | 405/204 |
| 4,498,412 | 2/1985 | Liden | 114/264 |
| 4,606,673 | 8/1986 | Daniell | 114/265 X |
| 4,611,952 | 9/1986 | Saint-M'Leuz | 405/224 |
| 4,620,820 | 11/1986 | Collipp | 114/265 X |
| 4,621,949 | 11/1986 | Marshall et al. | 405/202 |
| 4,630,970 | 12/1986 | Gunderson et al. | 405/224 |
| 4,648,747 | 3/1987 | Watkins | 405/224.2 |
| 4,679,964 | 7/1987 | Blandford | 405/216 |
| 4,749,309 | 6/1988 | Olsen | 405/204 |
| 4,784,528 | 11/1988 | Spalding et al. | 405/226 |
| 4,797,033 | 1/1989 | Pollack | 405/202 |
| 4,813,815 | 3/1989 | McGehee | 405/202 |
| 4,821,804 | 4/1989 | Pierce | 166/367 |
| 4,861,196 | 8/1989 | Folse | 405/224 |
| 4,923,337 | 5/1990 | Huard | 405/224 |
| 4,983,074 | 1/1991 | Carruba | 405/227 |
| 4,983,630 | 1/1991 | Karsan et al. | 405/224 |
| 5,044,828 | 9/1991 | Berner, Jr. et al. | 405/202 |
| 5,046,896 | 9/1991 | Cole | 405/195 |
| 5,094,567 | 3/1992 | Nista et al. | 405/227 |
| 5,118,221 | 6/1992 | Copple | 405/224.2 |
| 5,443,330 | 8/1995 | Copple | 405/224.2 |
| 5,542,783 | 8/1996 | Pollack | 405/224 X |
| 5,575,592 | 11/1996 | Pollack | 405/223.1 |
| 5,609,442 | 3/1997 | Horton | 405/204 X |
| 5,707,178 | 1/1998 | Srinivasan | 405/223.1 |
| 5,722,797 | 3/1998 | Horton, III | 405/224 |

BUOYANT LEG PLATFORM WITH RETRACTABLE GRAVITY BASE AND METHOD OF ANCHORING AND RELOCATING THE SAME

BACKGROUND OF THE INVENTION

There exists an ever increasing demand for oil and gas production from offshore deep water sites. However, difficulty arises in bringing long prefabricated structures to a site, providing anchors at a desired seabed location, and anchoring the structures at great depth. Additionally, a deep water offshore platform must be able to tolerate the full range of conditions likely to be encountered at the site, including severe winds, waves, and currents. An effective anchoring system for a deep water drilling unit must be capable of restraining the structure to the drill site while also preventing excessive heave, pitch, and roll in high wind and strong waves conditions. This last objective is complicated by the fact that while anchoring systems restrain the platform from moving in calm seas, they also form an elastic system with a resonant frequency that can be within the frequency of wave motions encountered in deep ocean waters. An anchoring system that restrains a platform in calm seas can result in unacceptable heaving, pitching, and rolling of the platform in rough seas or high winds.

While several deep water platforms designs have been proposed and developed that permit drilling in deep offshore waters, existing designs are generally expensive to transport, difficult to secure to the seabed, and difficult to relocate. Moreover, some of the current designs are also prone to the suspension of drilling operations due to heave, pitch, and roll motions by high winds and waves. These problems greatly increase the cost of drilling exploratory and development wells in deep water sites.

The drilling and test production of deep water oil and gas wells is often achieved from a work deck supported atop a buoyant structure that is semi-submerged. These structures, however, still require that the buoyant structure be fixedly anchored to the seabed. For example, the tension leg platform uses steel cables or tubes anchored in the sea floor to hold in place a semi-submersible platform. The "Spar" approach uses multiple anchor lines, secured to the sea floor, to hold a semi-submerged caisson in place. Other proposed approaches for deep drilling include the use of flexible piles and tendons secured to the sea floor to anchor a floating platform in place. However, all of these approaches have the shortcoming that the platform cannot be easily relocated to new sites in addition to the fact that they all use expensive means to secure the platform to the seabed.

Therefore, one objective of the present invention is a mobile drilling unit that is relatively easy and inexpensive to construct and that can be economically relocated to other sites for cost-effective drilling.

Another objective of the present invention is to provide a mobile offshore deep water platform with a desirable motion response (drift, heave, pitch, and roll) in rough seas to permit drilling even under the conditions of high seas, swift currents, or strong winds.

SUMMARY OF THE INVENTION

The present invention may be briefly described as a mobile offshore drilling unit comprising a work deck, a buoyant leg structure for supporting the deck structure, and a retractable anchoring means comprised of a retractable gravity base and a plurality of vertical pre-tensioned tethers connecting the gravity base to the buoyant leg structure.

The combined effect of the buoyant leg configuration and the tension of the vertical tethers produces very acceptable motions in the most severe wind and wave conditions. The pretensioned vertical tethers curtail heave motion. However, the design still has some compliance to pitch and roll, leading to desirable response characteristics in high seas. Moreover, roll and pitch parameters can be minimized by the optimization of the draft, displacement, tether pretension and stiffness, and attachment lever arm.

It will be seen that a platform constructed in accordance with the foregoing is simple in design, inexpensive, easy to construct and well-suited to deep water, offshore applications. The unit can be relocated short distances by retracting the gravity base and using thrusters or tug boats to move the unit around an exploratory region. Moreover, the platform can be conveniently relocated long distances by retracting the gravity base and disassembling the component parts of the unit for transportation and reassembly in a new location.

The above features and advantages of the present invention, together with the superior aspects thereof, will be appreciated by those skilled in the art upon reading of the following detailed description in conjunction with the drawings.

DESCRIPTION OF THE PREFERRED EMBODIMENTS

Figure 1:
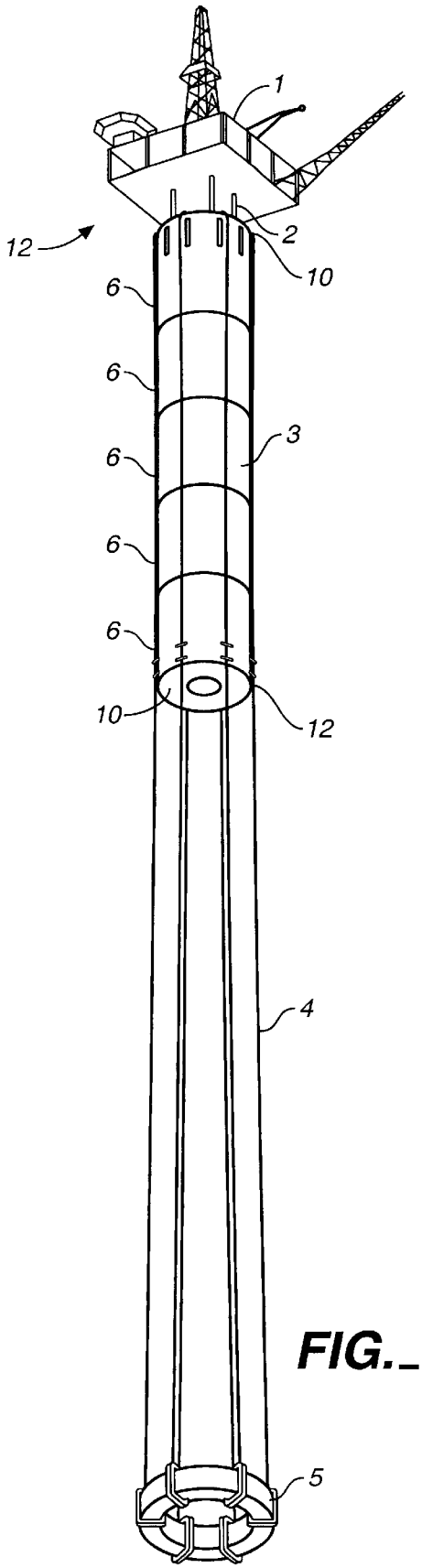
FIG. 1 is a perspective view, not to scale, of a deep water oil platform in accordance with the present invention.

FIG. 1 is a perspective view of an assembled deep water offshore mobile drilling unit as described in the present invention. A deck structure 1 supports the drilling, production, utility systems, and living quarters of the offshore platform. The deck structure is supported by legs 2 on top of buoyant leg structure 3 that is largely submerged. The buoyant leg structure 3 is moored by vertical tethers 4 connected to a disk-shaped gravity base 5. As can be seen in FIG. 1, the buoyant leg structure 3 has a first surface end 10 that is elevated above the surface of the water in the assembled unit and a second keel end 12 that is submerged underneath the water in the assembled unit.

Figure 2:
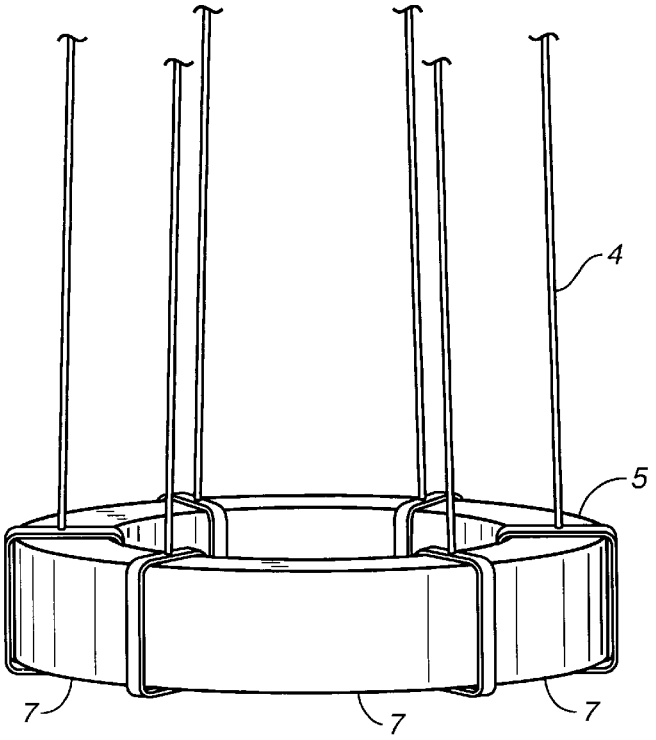
FIG. 2 is a detail view of the gravity base.

The buoyant leg structure 3 is comprised of multiple tanks or ballast compartments 6. A buoyant leg structure using different anchoring systems are disclosed in prior U.S. Pat. Nos. 5,443,330 and 5,118,221 to one of the inventors hereof. The disclosures of these patents are incorporated by reference. As shown in FIG. 2, the gravity base 5 is also comprised of multiple ballast compartments 7.

Figure 3:
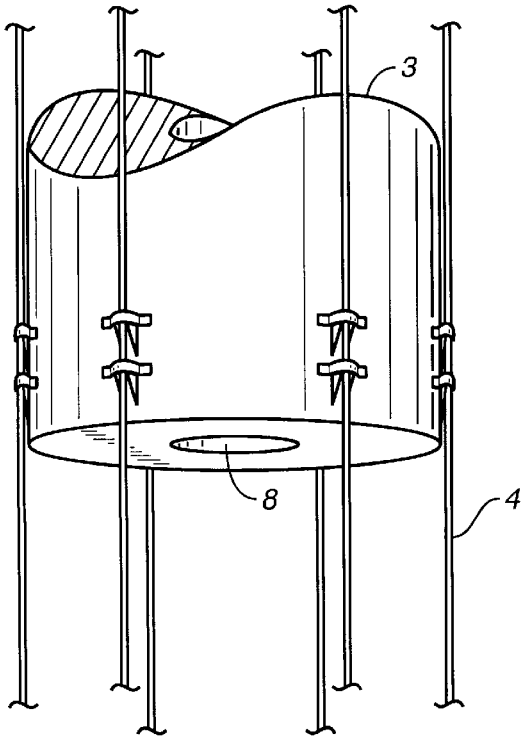
FIG. 3 is a detail view of the keel of the buoyant leg structure.

The bottom compartments of buoyant leg structure 3 are ballasted after installation to provide the unit with positive stability. As shown in FIG. 3, the buoyant leg structure 3 contains a centerwell 8 through which the drill string is extended through the keel of the buoyant leg structure during drilling operations. The centerwell 8 is situated along the central (long) axis of the buoyant leg structure.

Figure 4:
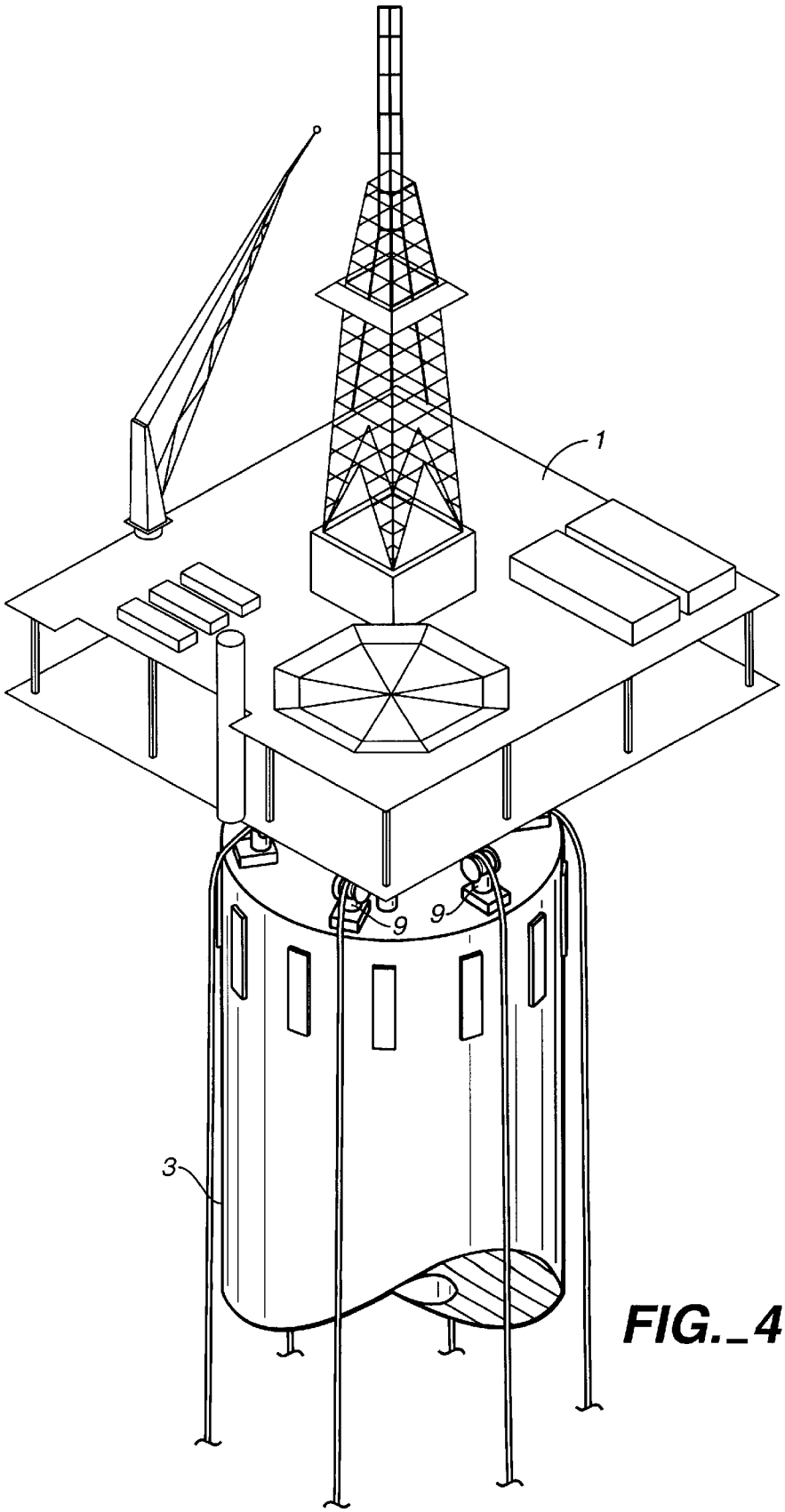
FIG. 4 is a detail view of the top of the buoyant leg structure.

The unit is assembled as follows. First the component parts are transported to the drill site. Several options exist for transporting the component parts. The buoyant leg structure 3 and the gravity base 5 may be either wet-towed or dry-towed to the site. The buoyant leg structure and gravity base are designed to float horizontally on the water surface when their ballast compartments are empty. The gravity base 5 is connected to the buoyant leg structure 3 with tethers 4. This step can be done at the drilling site or the gravity base 5 and the buoyant leg structure 3 may be tethered together and wet-towed to the drill site as a unit. Referring to FIG. 4, the tethers are connected to the top of the buoyant leg structure by means of hoists 9 such that the tethers can later be extended.

The buoyant leg structure is upended by adjusting the ballast tanks of the gravity base and the buoyant leg structure in a series of steps. First, the ballast of the gravity base 5 is increased to achieve near-neutral buoyancy. Then, the keel-end ballast compartments of the buoyant leg structure 3 are flooded to achieve a trim angle of the center axis of the buoyant leg structure of approximately 12 to 13 degrees with respect to the water surface. The ballast compartments of the gravity base 5 are then flooded, with the additional force coupled from the gravity base to the buoyant leg structure elevating the surface end of the buoyant leg structure 3 above the water surface and increasing the trim angle of the center axis to a 90 degree angle with respect to the water surface. Additional adjustment of the ballast in the ballast compartments 7 is then performed to achieve the desired draft of the buoyant platform and to provide sufficient buoyancy for the platform to support the weight of the work deck above the surface of the water.

The top deck structure 1 is then mounted to the top of the buoyant leg structure 3 by attaching the legs 2 of the deck structure to the buoyant leg structure. If desired, heavy mud or other materials can be pumped into the gravity base 5 to increase its mass further. The gravity base 5 is then lowered to the sea floor by means of hoists 9 that let out the tether cables 4. The length of the tethers 4 is then set and the tethers pre-tensioned by adjusting the ballast of the buoyant leg structure 3 to create a desired tension in the tethers.

The unit can be moved short distances in a drilling region by hoisting the gravity base off of the sea floor and using either dynamic-assist thrusters or tugboats to relocate the unit to other sites in a drilling region. For long distance relocation to new oil regions, the unit can be disassembled by reversing the order of the assembly process. The gravity base 5, can be retracted from the sea floor; the work deck demounted; and the gravity base and buoyant leg structure deballasted. The gravity base 5 can then be untethered from the buoyant leg 3, and the three major components transported separately to the new location. Alternatively, the gravity base can remained tethered to the buoyant leg structure for wet-towing of the gravity base and the buoyant leg as a single unit. As in the assembly process, the buoyant leg structure and the gravity base can be either wet-towed or dry-towed to the new site. The unit can then be reassembled, as described above.

The present invention is distinguishable over conventional retractable anchoring schemes used to moor ships and retractable anchoring schemes proposed to moor offshore platforms. While ships and floating platforms can be securely moored in shallow waters by using anchors and a multitude of anchor lines, such schemes are not practical for deep water offshore drilling. Conventional retractable anchoring schemes only secure a vessel or platform to within some fraction of the anchor line length. Conventional retractable anchoring systems with multiple cables and anchors also create elastic systems, that as described above, can suffer from resonance effects, thus leading to unacceptable heaving, pitching, and rolling of a platform in high seas. Moreover, these problems are exacerbated in the context of deep water drilling because of the long anchor line lengths and the heavy seas and strong ocean currents often experienced at many deep water sites far away from the shelter of land. Conventional retractable anchoring systems are thus not practical ways to secure a drilling platform in a deep water site.

The present invention has a combination of design features that make a retractable anchor design practical for deep water drilling. The combination of a buoyant leg structure and a multiplicity of precisely pre-tensioned tethers in the present invention leads to a greatly improved dynamic response over other retractable anchoring designs. The buoyant leg configuration itself minimizes excitational loads on the unit. The unit has positive stability because the bottom compartments of the buoyant leg 3 are ballasted to have a center of gravity below the buoyant leg's center of buoyancy. That, combined with the semi-compliant pre-tensioned tethering system minimizes the unit's response to excitational loads. The unit is a positively buoyant floater whose motion is fully restrained in only one (heave) of the six degrees of freedom by the pre-tensioned tethers. However, the tethers provide supplemental rotational and lateral restoring forces. The basic buoyant leg configuration has a low applied wave load because a large portion of total displacement is away from the water surface and thus subjected to relatively small water particle accelerations. Furthermore, the semi-compliant tethering system minimizes the platform's response to excitational loads. Additional dynamic assist thrusters may be added to supplement the tethering system in severe storm conditions.

The present invention is also distinguishable from conventional retractable anchoring systems in its method of installation. If one attempted to increase the tension on the anchor lines in a conventional anchoring system by winching in the anchor cables it would reduce the freeboard of the platform. In the present invention, however, the tethers are tensioned by adjusting the ballast of the buoyant leg structure. This permits the tethers to be tensioned while maintaining a nearly constant freeboard of the platform. The combination of elements in the present invention thus not only permits the tethers to be precisely tensioned but also allows for the simultaneous control of platform freeboard, buoyant leg draft, and ballast distribution. This control enables several key parameters affecting platform stability to be simultaneously optimized.

The dynamic response of the unit is a function of such factors as buoyant leg draft, size, and ballasting; tether number, tension, flexibility, weight, and length; platform load; and water depth. The methods of analyzing the dynamic response of such a unit are generally known to those skilled in the art. For a desired platform load and a given water depth, the buoyant leg and tether parameters can be analyzed and selected for optimum dynamic response.

The dynamic response of a preferred embodiment was analyzed using conventional modeling and computer analysis. The buoyant leg structure in the preferred mode is as follows. A platform deck area of 46 by 46 m and a payload of 13,000 tons (11,801 metric tons) was chosen as being consistent with an exploratory and extended production test system. An additional 3000 tons (2,722 metric tons) of associated deck and riser steel is assumed. An assumed water depth of 915 m was selected as being consistent with deep water drilling.

The corresponding buoyant leg structure has a 23.8 m outer diameter, a length of 141.8 m, and a 8.0 m centerwell. The estimated weight of the buoyant leg and appurtenances is 10,600 tons (9,616 metric tons). The buoyant leg structure has 9 inner watertight flats separated by approximately 15.2 m intervals. Of the 9 inner watertight compartments, the lowest three or four tanks are permanently ballasted with a weight of 29,900 tons (27,125 metric tons) of ballast to provide positive stability to the buoyant leg. Additional stiffening of the outer shell with stringers and rings is desirable, with the preferred arrangement consisting of 96 stringers and ringers spaced from 1.2 m to 2.4 m.

The tethers may consist of either wire rope or synthetic materials. Initial analysis indicates that eight tethers, each consisting of 4¾ inch spiral strand wire ropes with a breaking strength of 12.2 MN (2,750 kips) is suitable for water depths from 500 to 1,500 m. The combined tension and weight of the tethers is 3,800 tons (3,447 metric tons). In the preferred mode, the hoists would be comprised of synchronized winches to precisely control all of the tether lengths simultaneously.

The gravity base is a cylindrical shell with an inner diameter of 25.0 m and an outer diameter of 35.0 m. Eight non-watertight bulkheads on the gravity base serve as structural supports for the vertical tethers.

Figure 5:
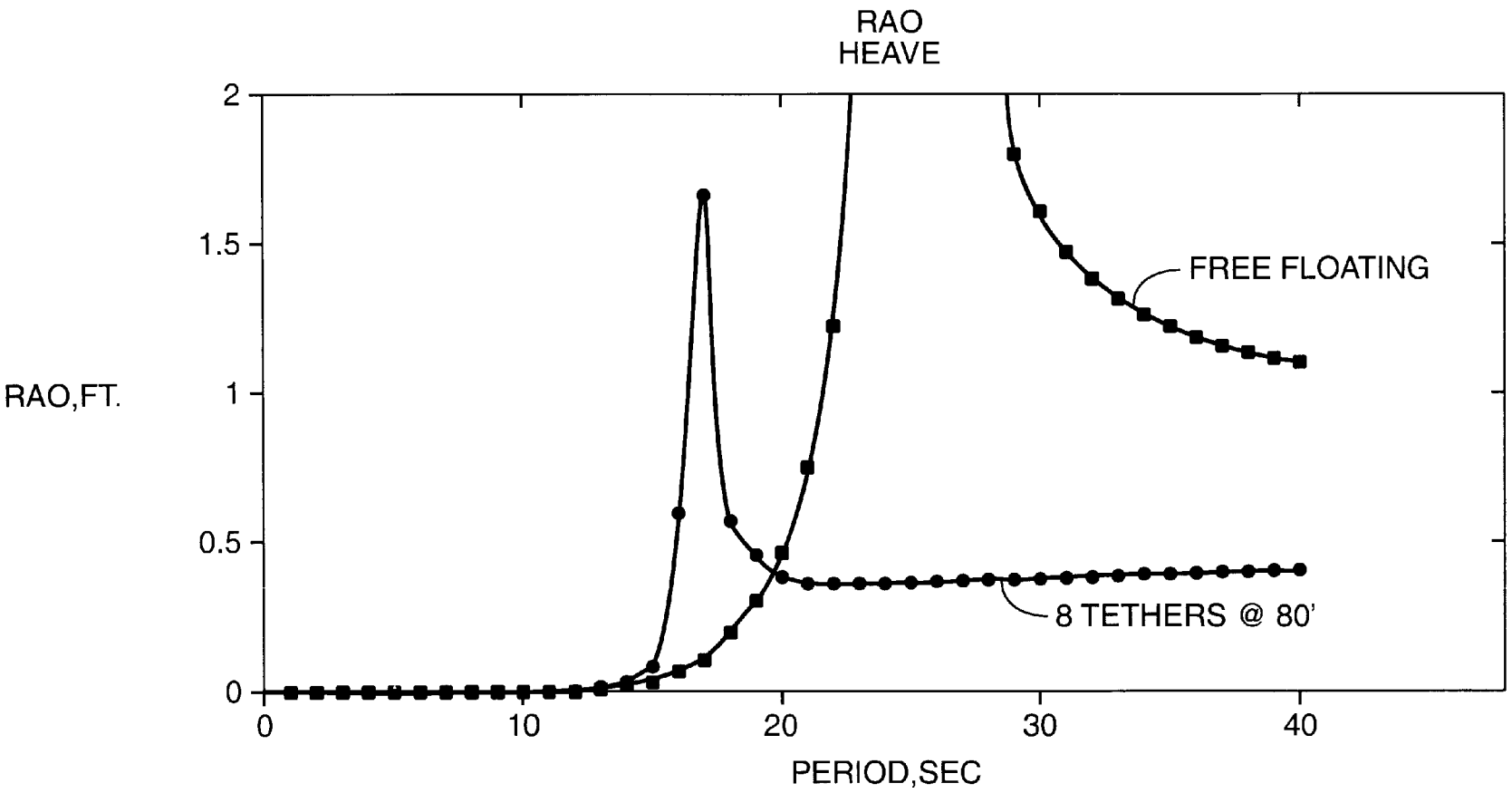
FIG. 5 is a chart of the calculated heave response of the preferred embodiment of the platform.
Figure 6:
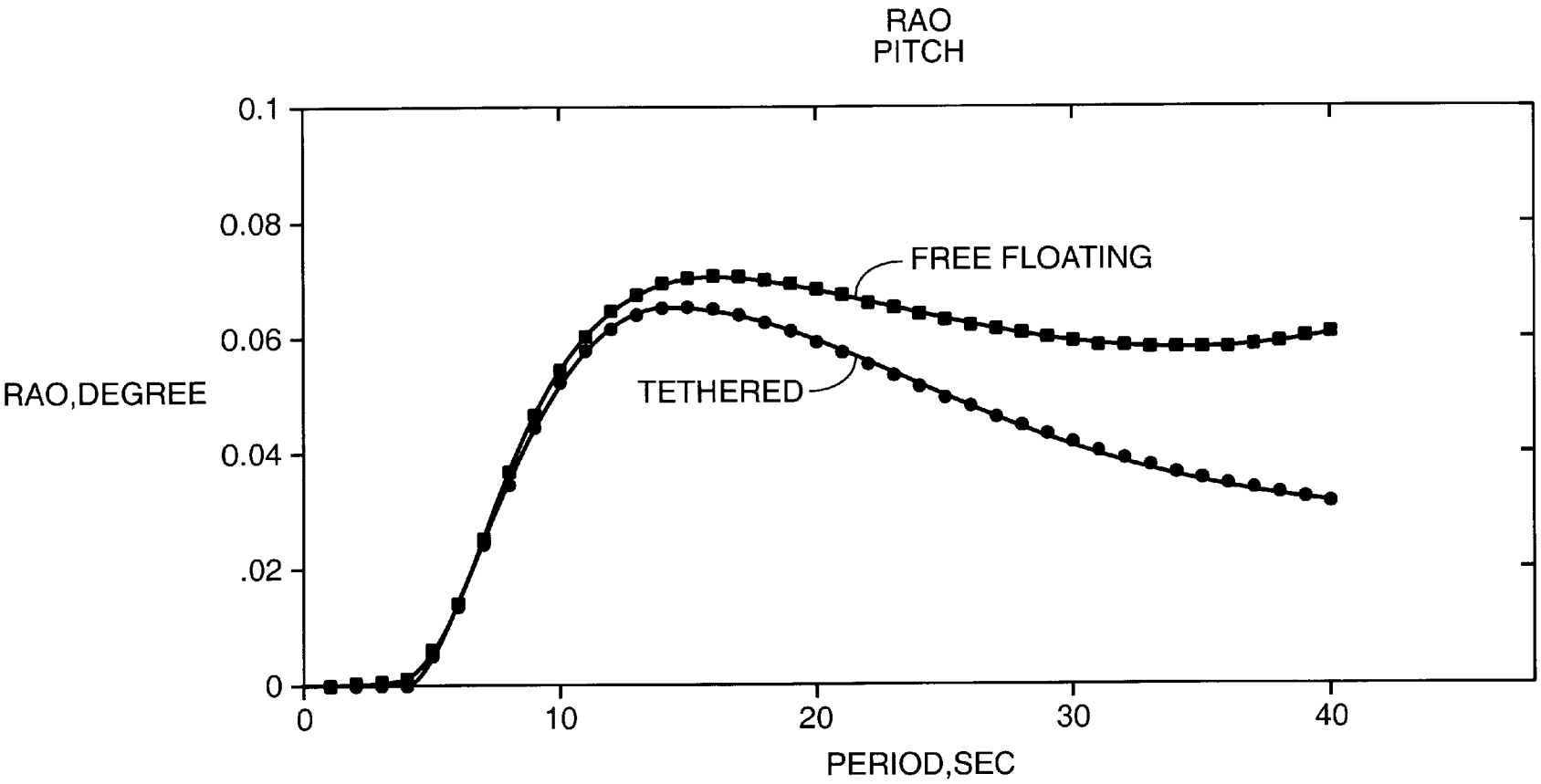
FIG. 6 is a chart of the calculated pitch response of the preferred embodiment of the platform.

Computer modeling for these choices of parameters indicate that the motions of this unit are smaller than a similar free-floating unit with deeper draft due to the beneficial effects of tether stiffness and pretension. The natural heave period in the free-floating mode is 25.0 seconds. When tethered to the sea floor at an ocean depth of 915 m by eight 4.75 in diameter wire ropes, the heave natural period is reduced to 19 seconds while the pitch/roll natural period is reduced from 83 seconds to 75 seconds. The lateral displacement (surge and sway) natural period is 297 seconds. All of the natural periods remain above the energy-intensive wave spectra, which mitigates against resonance effects and the problems of ringing and springing. FIG. 5 illustrates both the free floating and the tethered heave response amplitude operators (RAOs), demonstrating that the tethering substantially reduces the heave RAOs. As illustrated in FIG. 6, tethering also reduces the pitch and roll motion RAOs as well. The platform is expected to exhibit desirable motion characteristics even when subjected to severe storms in water depths from 500 to 3,000 m.

Although a particular embodiment has been described, it is apparent that a wide choice in design parameters is possible. The tether tension and the mass and mass distribution of the unit can be adjusted to obtain close-to-optimum pitch/roll RAOs for a given configuration. Other design parameters can be adjusted for particular applications. For example, one or more of the compartments of the buoyant leg can be used for oil storage and the diameter of the buoyant leg increased for greater oil storage capacity. The size and shape of the buoyant leg structure and the anchor configuration may also be varied, such as, for example, the use of multiple buoyant legs or multiple retractable anchors.

What is claimed is:

1. A mobile deep water offshore oil platform with a retractable anchoring system to secure the platform at a drilling site in a body of water, the platform comprising:

a column-shaped buoyant leg structure with a first end and a second end, the length of the buoyant leg structure being greater than the diameter of the buoyant leg structure;

a work deck coupled to said first end of said buoyant leg structure;

a gravity base containing at least one ballast compartment for ballasting and deballasting said gravity base;

a plurality of tethers coupling said buoyant leg structure to said gravity base;

a hoist to lower and retract said tethers, said hoist located on the first end of said buoyant leg structure and capable of lowering the attached gravity base to the bottom of the body of water; and a ballast compartment in said buoyant leg structure to control the tension of said tethers after said gravity base is lowered to the bottom of the body of water;

wherein in the assembled platform, the ballast distribution of said buoyant leg structure is selected so that the center of gravity of the platform is below the center of buoyancy and the tether tension is selected to improve the response of the platform to the excitational loads of wind, waves and currents.

2. The deep water drilling platform of claim 1 wherein the buoyant leg structure is comprised of a plurality of watertight ballast compartments.

3. The deep water drilling platform of claim 2 wherein at least one of the ballast compartments located adjacent to said second end of said buoyant leg structure in the assembled platform is permanently ballasted.

4. The deep water drilling platform of claim 2, wherein the ballast compartments in the lower half of the buoyant leg structure proximate the second end are ballasted with a ballast having a total weight greater than the work-deck and a payload.

5. The deep water drilling platform of claim 1 wherein the gravity base is disk-shaped and has an inner diameter that is about the same as the diameter of the buoyant leg structure.

6. The deep water drilling platform of claim 5, wherein said buoyant leg structure has a center well.

7. A method for anchoring a deep water oil platform at a selected site with a gravity base coupled with pretensioned tethers, where the platform components comprise a work deck; a buoyant leg structure; a gravity base; hoists attached to the surface end of the buoyant leg structure; and tethers, the method of assembling and anchoring the platform comprising the steps of:

transporting the component parts to the drill site;

floating the unballasted gravity base and the unballasted buoyant leg structure into close proximity to one another;

coupling the gravity base to the buoyant leg structure with the tethers attached to the hoists on the buoyant leg structure;

ballasting the gravity base to achieve near-neutral buoyancy of the gravity base;

ballasting the buoyant leg structure with sufficient ballast to tilt the axis of the buoyant leg structure to a desired initial trim angle relative to the water surface;

increasing the ballast of the gravity base such that the increased ballast further rotates the axis of the buoyant leg structure to a trim angle of approximately 90 degrees relative to the water surface;

adjusting the ballast of the buoyant leg structure to obtain the desired draft and ballast distribution such that the buoyant leg structure becomes semi-submerged at a stable trim angle of 90 degrees with sufficient buoyancy to support the weight of the work deck above the surface of the water;

mounting the deck structure to the surface end of the buoyant leg structure;

lowering the gravity base to the sea floor and setting the tether length; and de-ballasting the buoyant leg structure to obtain a desired pretension of the tethers.

8. The method of claim 7 wherein the initial trim angle of the buoyant leg structure to the surface of the water after ballasting keel-end compartments is 12 to 13 degrees.

9. The method of claim 7 wherein the buoyant leg structure and gravity base components are transported to the drilling site by wet-towing.

10. The method of claim 9 wherein the buoyant leg structure and the gravity base are coupled together by the tethers and wet-towed to the drilling site as a single unit.

11. The method of claim 7 wherein the components are transported to the drilling site by dry-towing.

12. The method of claim 7 wherein the gravity base is lowered to the sea floor prior to mounting the work deck.

13. The method of claim 7 wherein the length of the tethers is controlled by a plurality of winches mounted on the buoyant leg structure and each winch is operated in a substantially synchronous manner so that the length of each tether is substantially the same.

14. The method of claim 7 wherein the mass of the gravity base is increased by pumping heaving mud into the ballast compartments of the gravity base.

* * * * *

CERTIFICATE OF CORRECTION

PATENT NO: 6,012,873

DATED: January 11, 2000

INVENTOR(S): ROBERT W. COPPLE, et al.

| | |
|---|---|
| [57] Abstract, line 5: | After "operations" insert --,-- |
| Column 1, line 18: | Delete "strong waves" and substitute therefor --rough sea--. |
| Column 1, line 26: | Delete "platforms" and substitute therefor --platform--. |
| Column 1, line 32: | Delete "motions" and substitute therefor --caused--. |
| Column 3, line 1: | After "First" insert --,--. |
| Column 3, line 29: | Delete "7" and substitute therefor --6--. |
| Column 3, line 39: | Delete "tether cables, and substitute therefor --tethers--. |
| Column 3, line 51: | After "leg" insert --structure--. |
| Column 3 line 53: | Delete "remained" and substitute therefor --remain--. |
| Column 4, line 20: | After "leg" insert --structure--. |
| Column 4, line 39 | After "cables" insert --,--. |
| Column 4, line 44: | After "thus" insert --,--. |
| Column 4, line 45: | After "tensioned" insert --,--. |
| Column 4, line 61: | Delete the first occurrence of "46" and substitute therefor --46 m--. |

CERTIFICATE OF CORRECTION

PATENT NO: 6,012,873

DATED: January 11, 2000

INVENTOR(S): ROBERT W. COPPLE, et al.

| | |
|---|---|
| Column 5, line 17: | Delete "500" and substitute therefor --500 m--. |
| Column 5, line 45: | Delete "500" and substitute therefor --500 m--. |
| Column 5, line 48: | Delete "tension and" and substitute therefor --tension,--. |
| Column 6, line 40: | Delete "pretensioned" and substitute therefor --pre-tensioned--. |
| Column 7, line 6: | Delete "pretensioned" and substitute therefor --pre-tensioned--. |

Signed and Sealed this

Tenth Day of April, 2001

*Attest:*

Nicholas P. Godici

NICHOLAS P. GODICI

*Attesting Officer*

*Acting Director of the United States Patent and Trademark Office*